US009638211B2

(12) United States Patent
Cho et al.

(10) Patent No.: US 9,638,211 B2
(45) Date of Patent: May 2, 2017

(54) SCROLL TONGUE PART AND ROTARY MACHINE INCLUDING THE SAME

(71) Applicant: HANWHA TECHWIN CO., LTD., Changwon-si (KR)

(72) Inventors: Jong Jae Cho, Changwon-si (KR); Bong Gun Shin, Changwon-si (KR); Seung Hoon Lee, Changwon (KR); Jin Soo Lee, Changwon (KR); Sung Chul Ahn, Changwon (KR)

(73) Assignee: Hanwha Techwin Co., Ltd., Changwon-si (KR)

( * ) Notice: Subject to any disclaimer, the term of this patent is extended or adjusted under 35 U.S.C. 154(b) by 417 days.

(21) Appl. No.: 14/293,380

(22) Filed: Jun. 2, 2014

(65) Prior Publication Data

US 2015/0063994 A1 Mar. 5, 2015

(30) Foreign Application Priority Data

Sep. 4, 2013 (KR) ..... 10-2013-0106294

(51) Int. Cl.
*F01D 9/04* (2006.01)
*F04D 29/42* (2006.01)
*F04D 29/44* (2006.01)

(52) U.S. Cl.
CPC ..... *F04D 29/422* (2013.01); *F04D 29/444* (2013.01)

(58) Field of Classification Search
CPC .. F04D 29/422; F04D 29/426; F04D 29/4206; F04D 29/428
See application file for complete search history.

(56) References Cited

U.S. PATENT DOCUMENTS 8,147,186 B2 * 4/2012 Ibaraki ..... F04D 29/4206 415/148
2011/0318176 A1 12/2011 Yen et al.
2012/0294711 A1 * 11/2012 Grigoriev ..... F04D 29/444 415/204

FOREIGN PATENT DOCUMENTS

JP 2008-067746 A 3/2008
JP 2012-007548 A 1/2012

* cited by examiner

*Primary Examiner* — John K Fristoe, Jr.
*Assistant Examiner* — Sabbir Hasan
(74) *Attorney, Agent, or Firm* — Sughrue Mion, PLLC

(57) ABSTRACT

There is provided a casing of a rotary machine which includes a diffuser part; a scroll part into which fluid emitted from the diffuser part flows; and a scroll tongue part including: a tongue portion; a bottom surface extending from a bottom surface of the diffuser part; and a flow opening provided between the tongue portion and the bottom surface, the fluid moving from the diffuser part to the scroll part through the flow opening, wherein the bottom surface of the scroll tongue part is coplanar with the bottom surface of the diffuser part.

8 Claims, 6 Drawing Sheets

SCROLL TONGUE PART AND ROTARY MACHINE INCLUDING THE SAME

CROSS REFERENCE TO RELATED APPLICATION

This application claims priority from Korean Patent Application No. 10-2013-0106294, filed on Sep. 4, 2013, in the Korean Intellectual Property Office, the disclosure of which is incorporated herein by reference in its entirety.

BACKGROUND

1. Field

Apparatuses consistent with exemplary embodiments relate to a scroll tongue part and a rotary machine including the same.

2. Description of the Related Art

Compressors, pumps, and air blowers, which compress fluid, have a structure of a rotary machine including a rotor.

In the related art, the rotary machine includes an impeller and a casing. The impeller is a rotor, and transfers rotational kinetic energy to fluid to increase a pressure of the fluid. To this end, the impeller includes a plurality of blades that help movement of the fluid and transfer energy to the fluid.

Much effort to improve a performance of the rotary machine is being made, and Korean Patent Publication No. 10-1996-0001494 discloses such compressor technology that reduces pressure loss of a vane compressor to enhance a performance of the vane compressor.

SUMMARY

One or more exemplary embodiments include a scroll tongue part, having a structure reducing pressure loss, and a rotary machine including the same.

Additional aspects will be set forth in part in the description which follows and, in part, will be apparent from the description, or may be learned by practice of the exemplary embodiments.

According to an aspect of an exemplary embodiment, there is provided a casing of a rotary machine which includes a diffuser part; a scroll part into which fluid emitted from the diffuser part flows; and a scroll tongue part including: a tongue portion; a bottom surface extending from a bottom surface of the diffuser part; and a flow opening provided between the tongue portion and the bottom surface, the fluid moving from the diffuser part to the scroll part through the flow opening, wherein the bottom surface of the scroll tongue part is coplanar with the bottom surface of the diffuser part.

The casing further includes a plurality of diffuser vanes provided on the bottom surface of the diffuser part.

The bottom surface of the scroll tongue part may be flush with the bottom surface of the diffuser part.

The rotary machine may be one of a compressor, a pump, and an air blower.

According to an aspect of another exemplary embodiment, there is provided a rotary machine including: an impeller comprising a blade; a diffuser part configured to increase a pressure of fluid passing through the impeller; a scroll part configured to compress the fluid emitted from the diffuser part; and a scroll tongue part provided at the scroll part, wherein, the scroll tongue part includes: a flow opening through which the fluid moves from the diffuser part to the scroll part, and a bottom surface extending coplanarly with a bottom surface of the diffuser part.

A diffuser vane may be formed at a bottom surface of the diffuser part.

The rotary machine may further include a collector part that is connected to the scroll part.

The rotary machine may be one of a compressor, a pump, and an air blower.

The scroll tongue part may further include a tongue portion, and the flow opening is a gap disposed between the tongue portion and the bottom surface of the scroll tongue part.

According to an aspect of another exemplary embodiment, there is provided a scroll tongue part of a rotary machine including: a tongue portion; a bottom surface extending from a bottom surface of a diffuser part; and a flow opening provided between the tongue portion and the bottom surface, fluid moving from the diffuser part to a scroll part through the flow opening, wherein the bottom surface of the scroll tongue part is flush with the bottom surface of the diffuser.

A plurality of diffuser vanes may be provided on the bottom surface of the diffuser part.

BRIEF DESCRIPTION OF THE DRAWINGS

The above and/or other aspects will become apparent and more readily appreciated from the following description of the embodiments, taken in conjunction with the accompanying drawings in which.

DETAILED DESCRIPTION

Figure 1:
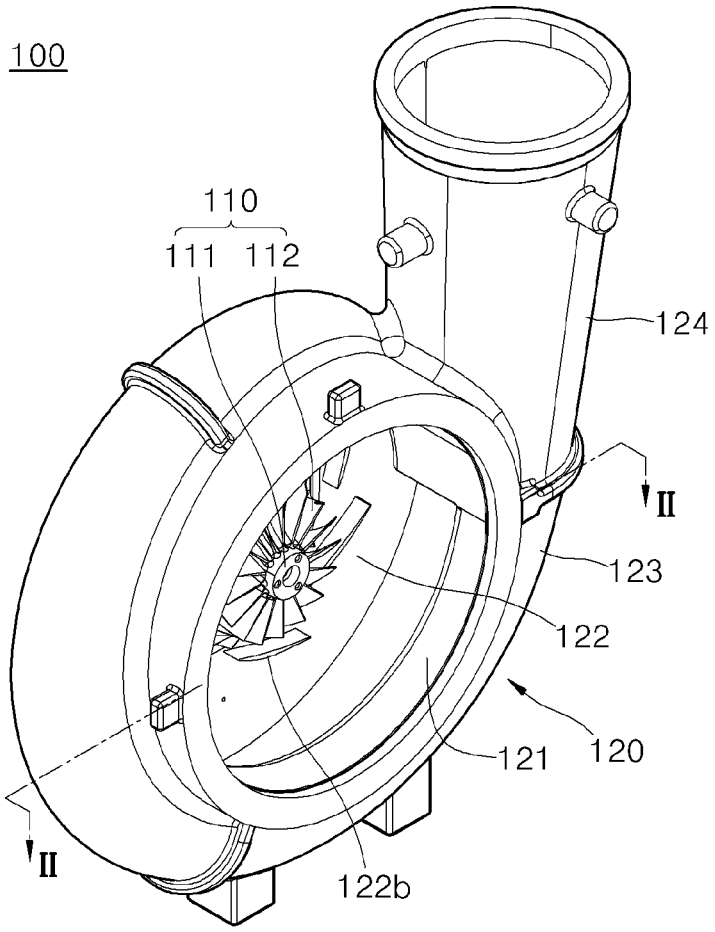
FIG. 1 is a perspective view of a rotary machine according to an exemplary embodiment.

Reference will now be made in detail to exemplary embodiments, examples of which are illustrated in the accompanying drawings, wherein like reference numerals refer to like elements throughout. In this regard, the exemplary embodiments may have different forms and should not be construed as being limited to the descriptions set forth herein. Accordingly, the exemplary embodiments are merely described below, by referring to the figures, to explain aspects of the present description. Expressions such as "at least one of," when preceding a list of elements, modify the entire list of elements and do not modify the individual elements of the list.

Figure 2:
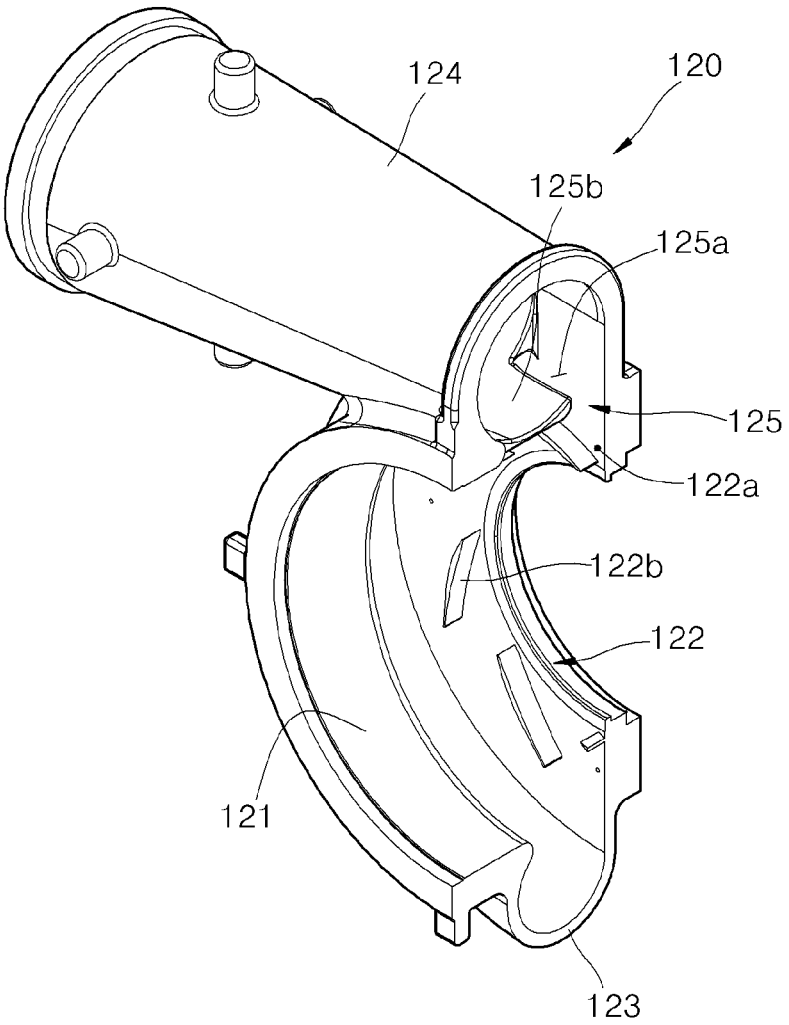
FIG. 2 is a cross-sectional view illustrating a casing of the rotary machine taken along line II-II of FIG. 1 according to an exemplary embodiment.
Figure 3:
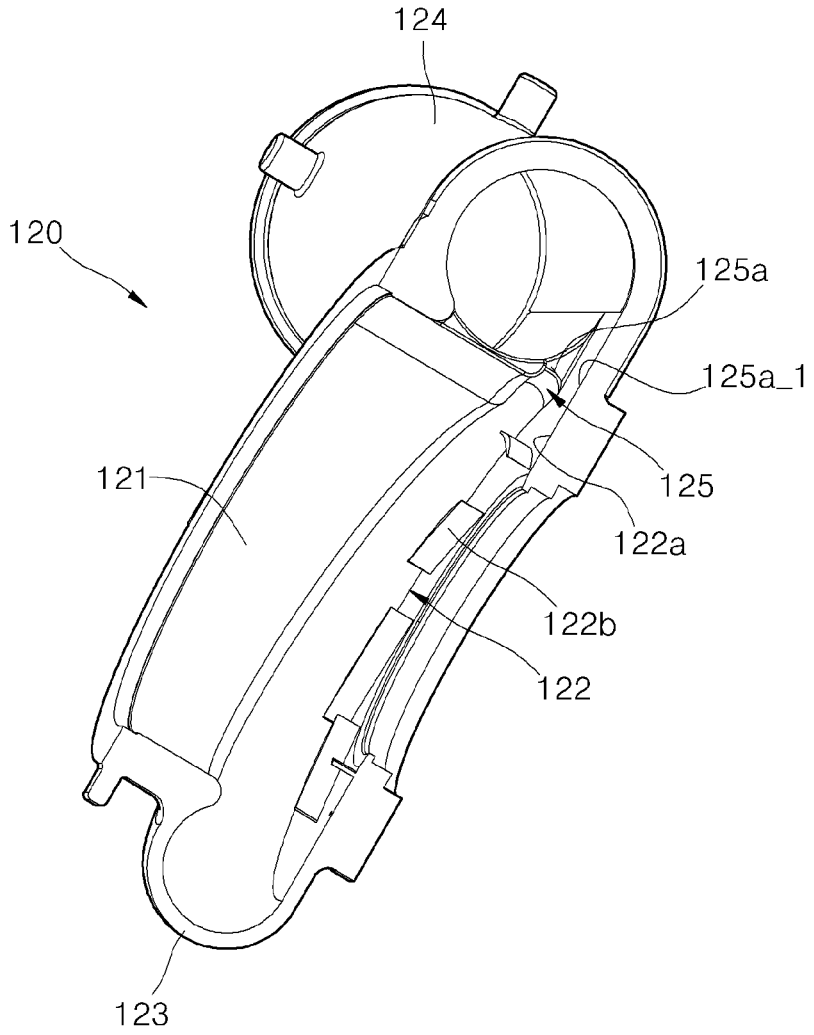
FIG. 3 is a view of a portion of the casing of FIG. 2 at a different angle according to an exemplary embodiment.
Figure 4:
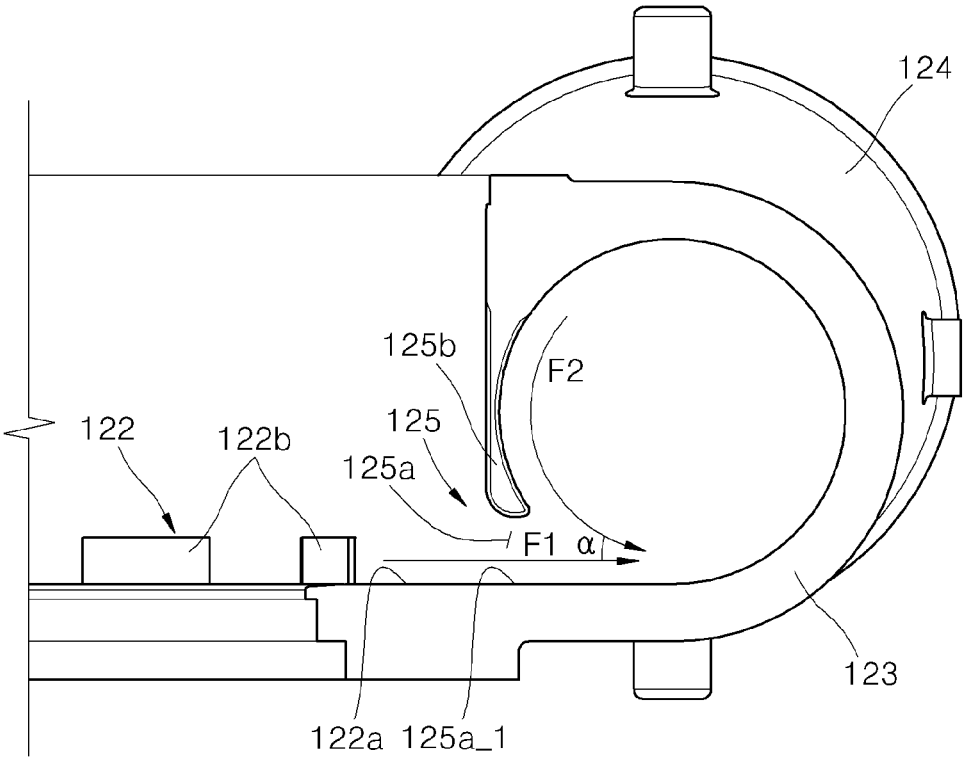
FIG. 4 is a view schematically illustrating a flow of fluid when the fluid passing through a diffuser enters a scroll, near a scroll tongue according to an exemplary embodiment.

FIG. 1 is a perspective view of a rotary machine 100 according to an exemplary embodiment. FIG. 2 is a view illustrating a casing 120 of the rotary machine 100 taken along line II-II of FIG. 1. FIG. 3 is a view of a portion of the casing 120 of FIG. 2 at a different angle. FIG. 4 is a view schematically illustrating a flow of fluid when the fluid passing through a diffuser part 122 enters a scroll part 123, near a scroll tongue part 125 according to an exemplary embodiment.

As illustrated in FIGS. 1 to 4, the rotary machine 100 according to an exemplary embodiment is a centrifugal compressor that compresses fluid. The rotary machine 100 includes an impeller 110 and the casing 120.

The rotary machine 100 according to an exemplary embodiment is the centrifugal compressor, but is not limited thereto. The rotary machine 100 may be any apparatus that changes a pressure and a speed of fluid according to rotational motion of a rotor. For example, the rotary machine 100 may be a pump, an air blower, or the like.

The fluid, which is compressed by the rotary machine 100, may be various fluids such as air, gas, vapor, liquid, etc.

The impeller 110 includes a hub 111 and a blade 112 that is provided on the hub 111. The hub 111 is fixed to a rotary shaft (not shown), and when the rotary shaft rotates, the impeller 110 rotates along with the hub 111.

The blade 112 is provided in plurality on the hub 111. The blade 112 guides movement of the fluid and transfers rotational kinetic energy of the impeller 110 to the fluid.

The casing 120 including the impeller 110 is a structure body or an assembly body in which a pressure of the fluid increases as the fluid moves through the impeller 110. The casing 120 includes an inflow part 121, the diffuser part 122, the scroll part 123, a collector part 124, and the scroll tongue part 125.

The inflow part 121 is an inlet that is formed at a central portion of the rotary machine 100 and through which the fluid to be compressed flows into the casing 120.

The diffuser part 122 reduces a speed of the fluid passing through the impeller 110 and increases a pressure of the fluid passing through the impeller 110, and a diffuser vane 122*b* that guides movement of the fluid is provided at a bottom surface 122*a* of the diffuser part 122.

The diffuser part 122 according to an exemplary embodiment includes the diffuser vane 122*b*, but the exemplary embodiment is not limited thereto. The diffuser part 122 may not include the diffuser vane 122*b*.

The fluid emitted from the impeller 110 passes through the diffuser part 122, and reaches the scroll part 123. The scroll part 123 is provided outside the diffuser part 122 in a radial direction of the casing 120.

The scroll part 123 may have a shape in which a flow cross-sectional area increases in a direction from a start portion to an end portion of the scroll part 123. This shape of the scroll part 123 reduces the speed of the fluid and increases the pressure of the fluid.

The collector part 124 is provided at one end of the scroll part 123, and the fluid, which is compressed by passing through the inside of the scroll part 123, is emitted to the outside through the collector part 124.

The scroll tongue part 125 is provided at the start portion of the scroll part 123, but the exemplary embodiment is not limited thereto. As another example, the scroll tongue part 125 may be provided at another portion of the scroll part 123.

The scroll tongue part 125 includes a tongue portion 125*b* and a flow opening 125*a* formed between the tongue portion 125*b* and a bottom surface 125*a*_1 of the scroll tongue part 125. Through the flow opening 125*a*, the fluid moves from the diffuser part 122 to the scroll part 123.

The bottom surface 125*a*_1 of the scroll tongue part 125 has a shape which planarly extends from the bottom surface 122*a* of the diffuser part 122. That is, the bottom surface 125*a*_1 of the scroll tongue part 125 is coplanar or flush with the bottom surface 122*a* of the diffuser part 122. The shape of the bottom surface 125*a*_1 reduces a contact angle between fluid flows when a flow of fluid (which enters the inside of the scroll part 123 via the flow opening 125*a*) joins a flow of fluid which flows in the scroll part 123, thereby decreasing pressure loss of the fluid. Details on this will be described below.

Hereinafter, an operation of the rotary machine 100 according to an exemplary embodiment will be described.

When a user operates the rotary machine 100, the impeller 110 receives power from the rotary shaft (not shown) to rotate.

When the impeller 110 starts to rotate, fluid to be compressed flows into the impeller 110 from the inflow part 121 of the casing 120, and the flowed fluid is provided with rotational kinetic energy of the impeller 110 by the blade 112 and is emitted to the diffuser part 122 at a high speed.

The fluid emitted to the diffuser part 122 moves according to guidance of the diffuser vane 122*b*. In this case, by the diffuser part 122, a speed of the fluid is reduced and a pressure of the fluid is increased.

Subsequently, the compressed fluid passing through the diffuser part 122 enters the scroll part 123, and thus, the compressed fluid further increases in pressure and is emitted to the outside through the collector part 124.

In the rotary machine 100 according to an exemplary embodiment, the shape of the bottom surface 125*a*_1 of the flow opening 125*a* of the scroll tongue part 125 is a shape which planarly extends from the bottom surface 122*a* of the diffuser part 122, and thus, pressure loss of fluid flow is reduced near the scroll tongue part 125. This will be described in detail with reference to FIG. 4.

As described above, the compressed fluid passing through the diffuser part 122 enters the inside of the scroll part 123. This transition region between the diffuser part 122 and the scroll part corresponds to a periphery of the scroll tongue part 125. That is, as illustrated in FIG. 4, first flow of fluid F1 passing through the diffuser part 122 disposed near the scroll tongue part 125 passes through the flow opening 125*a* and enters the scroll part 123.

Second flow of fluid F2, which has entered the scroll part 123 and flows according to guidance of the inside of the scroll part 123, exists in the scroll part 123 disposed near the scroll tongue part 125.

The first flow of fluid F1 joins the second flow of fluid F2 when the first fluid flow F1 passes through the flow opening 125*a* and enters the scroll part 123. In this case, as a contact angle $\alpha$ between the first and second fluid flows F1 and F2 decreases, the occurrence of a vortex is reduced. Since the shape of the bottom surface 125*a*_1 of the flow opening 125*a* is a shape which planarly extends from the bottom surface 122*a* of the diffuser part 122, the first fluid flow F1 horizontally enters the scroll part 123, and thus, the contact angle $\alpha$ is small. Accordingly, occurrence of a vortex is minimized, and thus, pressure loss of the fluid is reduced, thereby enhancing a performance of the rotary machine 100.

To more clearly describe the operation and effect of the above-described present embodiment, the casing according to an exemplary embodiment is compared with a casing of a rotary machine of the related art as a comparative example.

Figure 5:
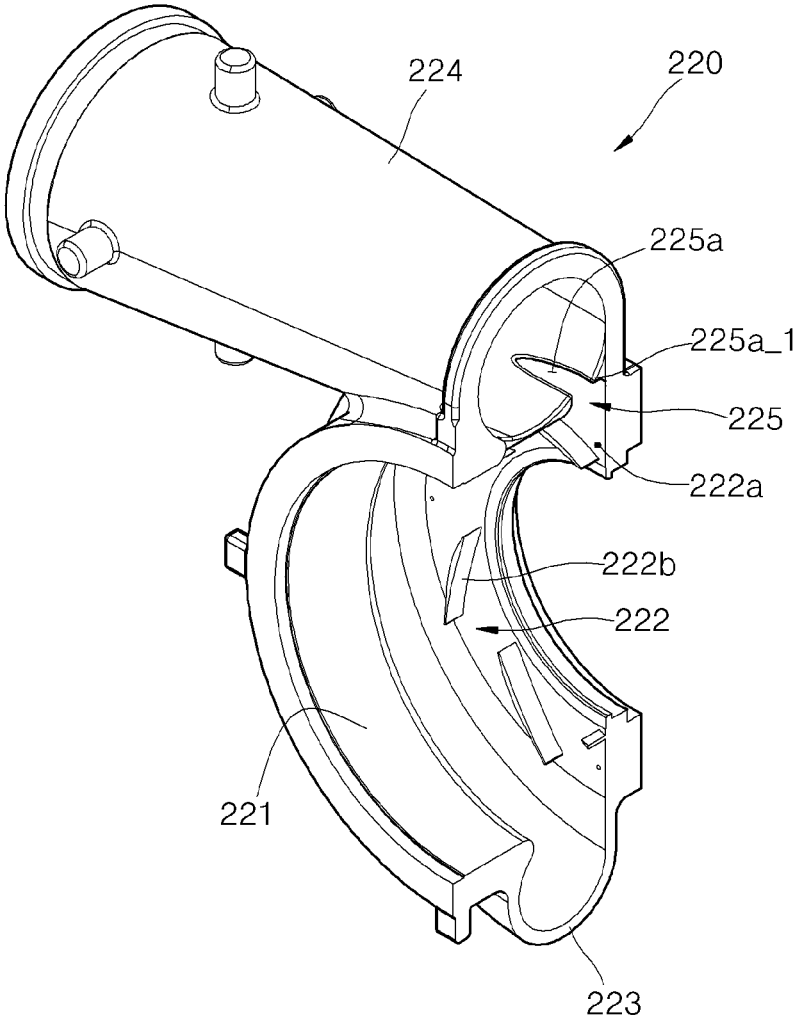
FIG. 5 (RELATED ART)
FIG. 5 is a cross-sectional view of a casing of a rotary machine of the related art as an a comparative example.
Figure 6:
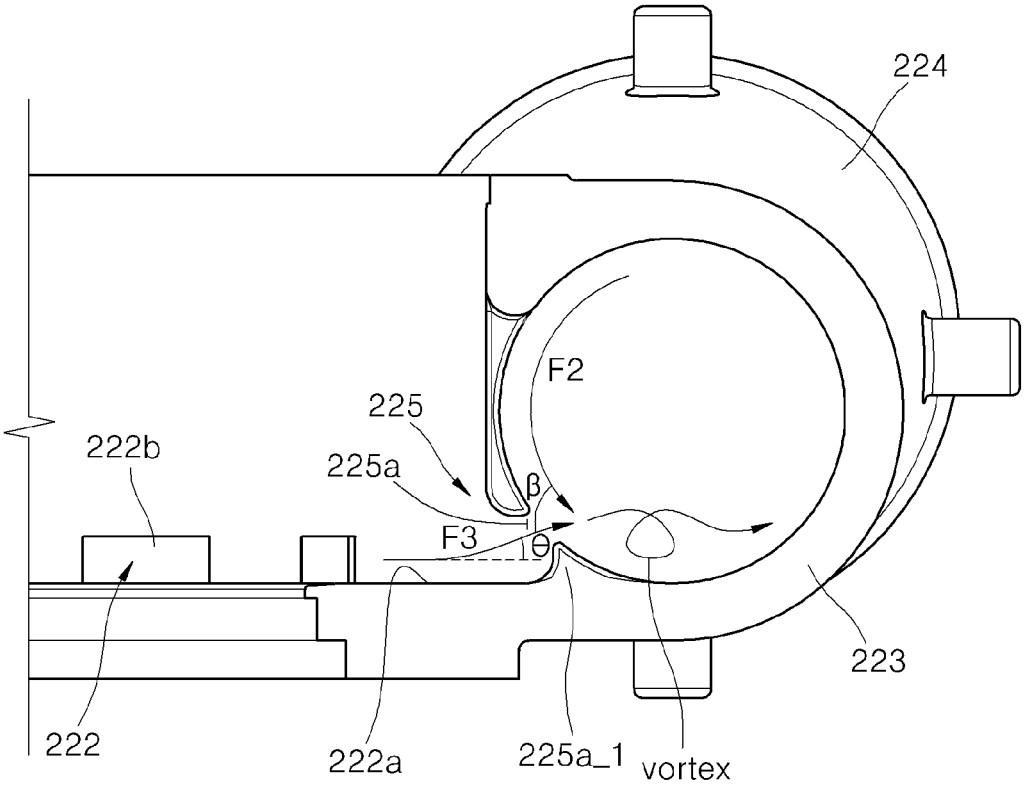
FIG. 6 (RELATED ART)
FIG. 6 is a view schematically illustrating a flow of fluid when the fluid passing through a diffuser enters a scroll, near a scroll tongue of the casing of the rotary machine of the related art.

FIG. 5 is a cross-sectional view of a casing of a rotary machine of the related art as a comparative example. FIG. 6 is a view schematically illustrating flow of fluid when the fluid passing through a diffuser enters a scroll, near a scroll tongue of the casing of the rotary machine of the related art.

As illustrated in FIG. 5, a casing 220 includes an inflow part 221, a diffuser part 222, a scroll part 223, a collector part 224, and a scroll tongue part 225.

A diffuser vane 222*b* is provided at a bottom surface 222*a* of the diffuser part 222. Unlike the exemplary embodiment of FIGS. 1-4, a protrusion portion 225*a*_1 is formed under a flow opening 225*a* which is formed at the scroll tongue part 225.

When an impeller rotates according to the rotary machine of the related art being driven, high-speed fluid is emitted to the diffuser part 222, and the fluid passing through the diffuser part 222 enters the inside of the scroll part 223.

As illustrated in FIG. 6, third flow of fluid F3 passing through the diffuser part 222 disposed near the scroll tongue part 225 passes through the flow opening 225*a* and enters the scroll part 223. The third fluid flow F3 is raised by an angle θ from a plane parallel to the bottom surface 222*a* of the diffuser part 222 by the protrusion portion 225*a*_1, which is formed under the flow opening 225*a*.

Second flow of fluid F2, which has entered the scroll part 223 and flows according to guidance of the inside of the scroll part 223, exists in the scroll part 223 disposed near the scroll tongue part 225.

The third fluid flow F3 joins the second fluid flow F2 when the third fluid flow F3 passes through the flow opening 225*a* and enters the scroll part 223. In this case, as a contact angle β between the second and third fluid flows F2 and F3 is relatively large, the occurrence of a vortex is induced. For this reason, pressure loss of the fluid increases, causing a reduction in the performance of the rotary machine.

On the other hand, in the rotary machine 100 according to an exemplary embodiment, the shape of the bottom surface 125*a*_1 of the flow opening 125*a* of the scroll tongue part 125 is a shape which planarly extends from the bottom surface 122*a* of the diffuser part 122, and thus, when flow of fluid which passes through the flow opening 125*a* and enters the inside of the scroll part 123 joins flow of fluid which flows in the scroll part 123, a contact angle between the fluid flows is small, thereby reducing pressure loss of the fluid. Accordingly, a performance of the rotary machine 100 is enhanced.

Moreover, in the rotary machine 100 according to an exemplary embodiment, since the shape of the bottom surface 125*a*_1 of the flow opening 125*a* of the scroll tongue part 125 is a shape which planarly extends from the bottom surface 122*a* of the diffuser part 122, it is easy to manufacture the scroll part 123 and the scroll tongue part 125, thereby decreasing a failure rate. To describe a casting method as an example of a manufacturing method, since the scroll tongue part 225 of the casing 220 illustrated in FIG. 6 includes the protrusion portion 225*a*_1, a structure of a wooden pattern for casting is complicated, and thus, in a manufacturing process, a step height occurs, or a risk of a damage increases. On the other hand, since the shape of the bottom surface 125*a*_1 of the flow opening 125*a* of the scroll tongue part 125 according to an exemplary embodiment is a shape which planarly extends from the bottom surface 122*a* of the diffuser part 122, a structure of a wooden pattern for casting is simple, thereby decreasing defects such as a step height and facilitating a manufacturing process.

As described above, according to the one or more of the above exemplary embodiments, fluid pressure loss in a scroll of a rotary machine is reduced, thereby enhancing the performance of the rotary machine.

It should be understood that the exemplary embodiments described therein should be considered in a descriptive sense only and not for purposes of limitation. Descriptions of features or aspects within each embodiment should typically be considered as available for other similar features or aspects in other embodiments.

While exemplary embodiments have been particularly shown and described above, it will be understood by those of ordinary skill in the art that various changes in form and details may be made therein without departing from the spirit and scope of the inventive concept as defined by the following claims.

What is claimed is:

1. A casing of a rotary machine comprising:
- a diffuser part;
- a scroll part into which fluid emitted from the diffuser part flows;
- a collector part connected to the scroll part;
- a scroll tongue part provided at a connection portion between the scroll part and the collector part; and
- the scroll tongue part comprising:
- a tongue portion;
- a bottom surface extending from a bottom surface of the diffuser part; and
- a flow opening provided between the tongue portion and the bottom surface, the fluid moving from the diffuser part to the scroll part through the flow opening,
- wherein the bottom surface of the scroll tongue part is coplanar with the bottom surface of the diffuser part.

2. The casing of claim 1, wherein the casing further comprises a plurality of diffuser vanes provided on the bottom surface of the diffuser part.

3. The casing of claim 1, wherein the bottom surface of the scroll tongue part is flush with the bottom surface of the diffuser part.

4. The casing of claim 1, wherein the rotary machine is one of a compressor, a pump, and an air blower.

5. A rotary machine comprising:
- an impeller comprising a blade;
- a diffuser part configured to increase a pressure of fluid passing through the impeller;
- a scroll part configured to compress the fluid emitted from the diffuser part;
- a collector part connected to the scroll part; and
- a scroll tongue part provided at a connection portion between the scroll part and the collector part,
- wherein, the scroll tongue part comprises:
- a flow opening through which the fluid moves from the diffuser part to the scroll part, and
- a bottom surface extending coplanarly with a bottom surface of the diffuser part.

6. The rotary machine of claim 5, wherein a diffuser vane is provided on the bottom surface of the diffuser part.

7. The rotary machine of claim 5, wherein the rotary machine is one of a compressor, a pump, and an air blower.

8. The rotary machine of claim 5, wherein the scroll tongue part further comprises a tongue portion, and
- wherein the flow opening is a gap disposed between the tongue portion and the bottom surface of the scroll tongue part.

* * * * *